US005568452A

United States Patent [19]

Kronenberg

[11] Patent Number: 5,568,452

[45] Date of Patent: Oct. 22, 1996

[54] ALARM CLOCK

[76] Inventor: Harry Kronenberg, 1474 Van Dyke Rd., San Marino, Calif. 91108

[21] Appl. No.: 786,125

[22] Filed: Nov. 1, 1991

[51] Int. Cl.[6] ..... G04B 23/02

[52] U.S. Cl. ..... 368/262; 368/72

[58] Field of Search ..... 368/10, 72–74, 368/243–244, 250, 254, 262, 263

[56] References Cited

U.S. PATENT DOCUMENTS 2,504,811 4/1950 Davis et al. ..... 368/228

2,677,228 5/1954 Paul et al. ..... 368/72

4,730,284 3/1988 Adams ..... 368/72

5,095,468 3/1992 Sato ..... 368/272

*Primary Examiner*—Bernard Roskoski

[57] ABSTRACT

An alarm clock is provided which has a moving display signal and a characteristic sound signal. The alarm clock comprises a housing having an interior chamber, an actionable member located within the interior chamber, and means for moving the actionable member at a predetermined time. Further provided are sound generating means generating a characteristic sound signal.

24 Claims, 3 Drawing Sheets

ALARM CLOCK

BACKGROUND OF THE INVENTION

1. Field of the Invention

The present invention relates to an alarm clock. In particular, the invention relates to an alarm clock emitting both a sound alarm and an actionable figure moving display at a predetermined time.

2. Description of the Prior Art

A variety of novelty alarm clocks have been developed to overcome the annoyance of waking at a pre-determined time. These novelties include clocks shaped like cartoons or other children's characters, which emit characteristic sounds.

Other alarm clocks require the user to throw the clock, or a detachable part of it, to deactivate the alarm sound.

With the advent of microcomputers, alarm clocks are now available with "voice" alarms announcing the time or messages like "Wake up," "Good morning, please hurry," "Go to school."

Despite these novelties and advances in microcomputers for generating a variety of sounds, there does not appear to be available an alarm clock that produces moving displays of action figures along with a variety of sounds.

SUMMARY OF THE INVENTION

In accordance with the present invention, an alarm clock is provided for emitting a characteristic sound signal and a moving display signal at a predetermined time. The alarm clock comprises a housing which has an interior chamber. The surface of the housing defines an opening in the housing. Located within this interior chamber is an actionable member. The actionable member is sized to fit through the housing opening.

The alarm clock further comprises release means for moving the actionable member from a first position in the interior chamber to a second position. In the second position, the actionable member is at least partly extended through the housing opening.

The alarm clock further comprises a clock mechanism, including a clock display, mounted within the housing. The clock mechanism includes alarm means for setting a preselected alarm signal generated by the clock mechanism.

Sound generating means are provided for generating a characteristic sound signal in response to the alarm signal.

Actuation means are provided for operating the release means and the sound generating means in response to the alarm signal.

As a feature of the invention, a switch is mounted within the housing. The switch can disable the characteristic sound signal when the actionable member is manually moved or displaced from the second position into the first position in the interior chamber.

Other objects, features and advantages of the invention will become apparent from a consideration of the following detailed description and from the accompanying drawings.

DETAILED DESCRIPTION OF THE INVENTION

Figure 1:
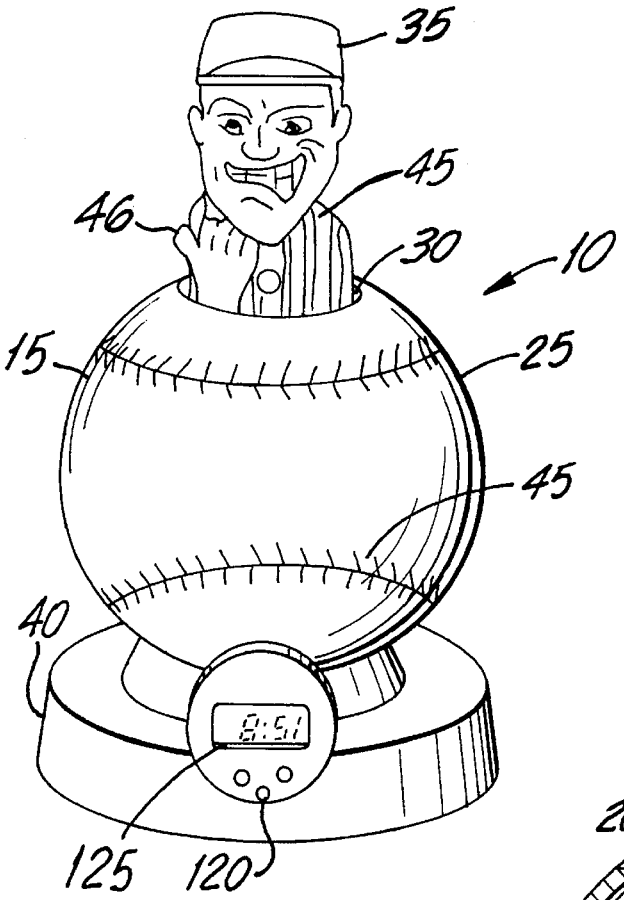
FIG. 1 is a front perspective view of an embodiment of the alarm clock showing a housing having the shape and surface indicia of a baseball and an actionable member being a baseball umpire in a second position extending through the opening of the housing.
Figure 3:
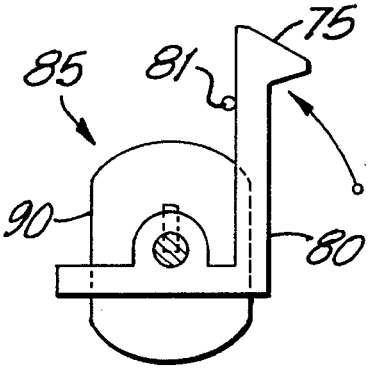
FIG. 3 is a fragmentary enlarged section of the release means shown in FIG. 2 showing an arm with a projection in biased rotary attachment to the rotary solenoid motor.

Referring to FIGS. 1 through 6, an alarm clock 10 is provided with a housing 15. The housing 15 has an interior chamber 20 and a surface 25 which defines an opening 30 in the housing 15 that communicates with the interior chamber 12.

The alarm clock 10 features an actionable member 35 which is located within the interior chamber 20. The actionable member 35 is sized to fit through the opening 30. In a typical embodiment of the alarm clock 10, the housing 15 further includes a base 40.

In accordance with the invention, the housing 15 can take a variety of forms. A preferred form of the housing 15, as shown in FIG. 1, is a sports ball, such as a baseball. The housing 15 can be shaped in the form of other sport balls, including, but not limited to a football, basketball, golf ball, soccer ball, tennis ball, and volley ball. Indicia 45 or markings are positioned on the housing 15 to further simulate the sports ball. As shown in FIG. 1, indicia 45 representing stitches make the ball-shaped housing 15 resemble a baseball.

Figure 2:
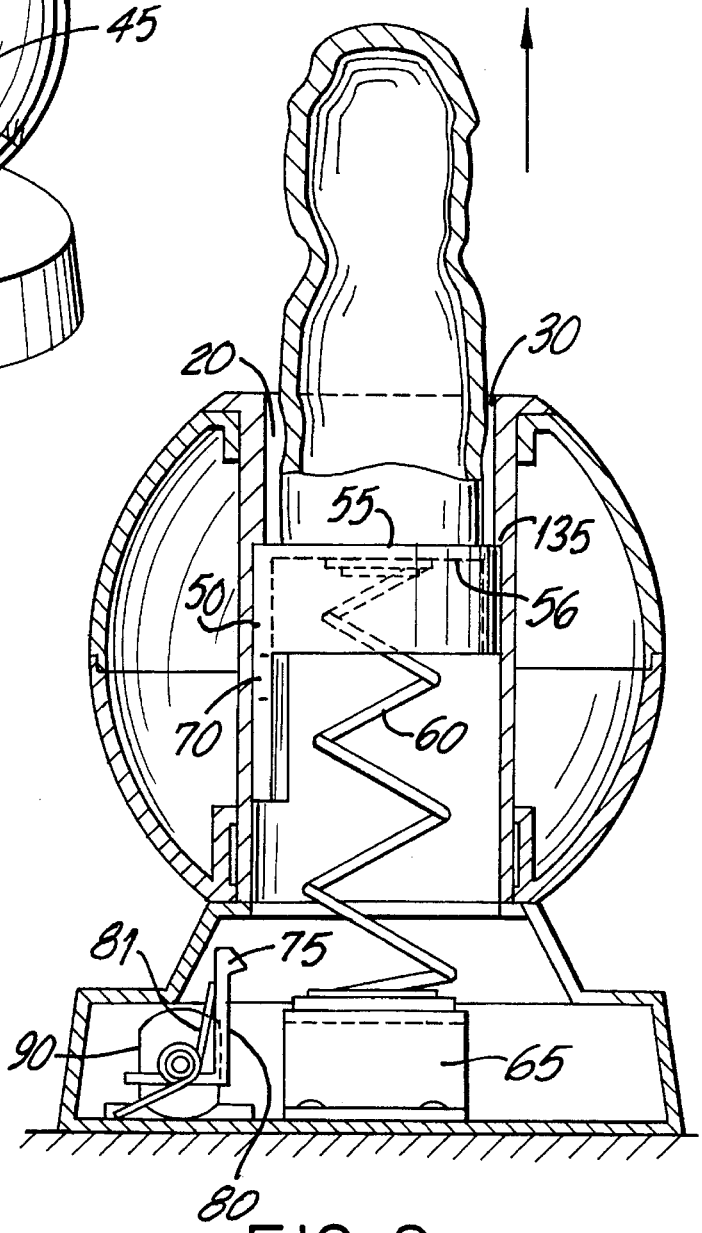
FIG. 2 is a front section of the alarm clock shown in FIG. 1 showing the actionable member in a second position extended through the housing opening. In this position, the alarm is on and the sound generating means is generating a characteristic sound signal.
Figure 4:
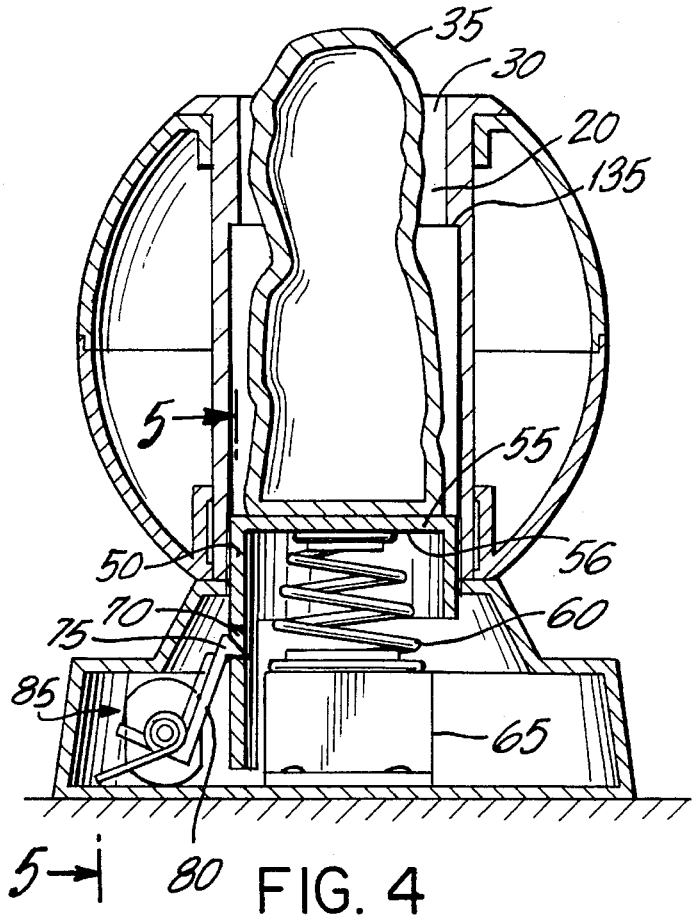
FIG. 4 is a front section of the alarm clock shown in FIG. 1 showing the actionable member in a first position in the interior chamber. In this position, the alarm is off.
Figure 5:
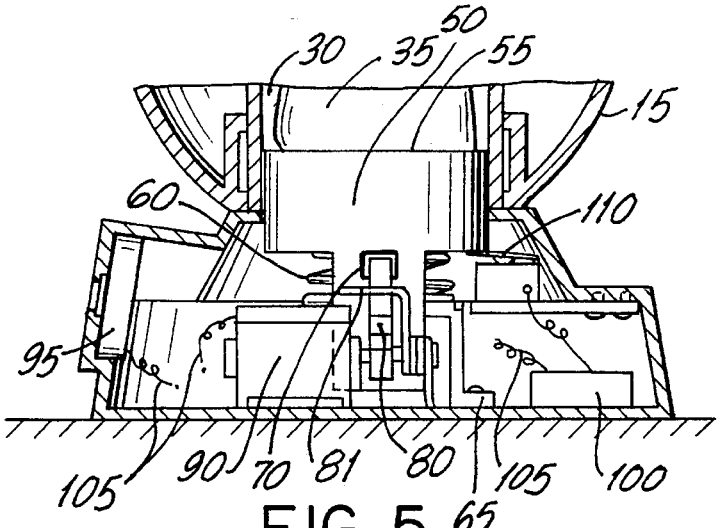
FIG. 5 is a section thru line 5—5 of FIG. 4.

In a typical construction of the alarm clock 10, the actionable member 35 includes a carrier portion 50 located within the interior chamber 20. As shown in FIGS. 2, 4 and 5, the carrier portion 50 can be cylindrically shaped, with a platform 55 situated toward the top of the carrier 50. The portion of the actionable member 35 which extends at least partly through the housing opening 30 extends upward from the platform 55. The cylindrically shaped carrier portion 55 of the actionable member 35 has walls 57 extending downward from the platform 55. The bottom of the cylindrical shaped carrier portion 50 is open. A spring 60 having an upper end and a lower end is attached at its upper end to the bottom side 56 of the platform 55. The lower end of the spring 60 is attached to a stand 65 at the bottom of the housing 15. The spring 60 biases the actionable member 35 upward. An aperture 70 is located in the wall of the carrier portion for engaging a projection 75 located on an arm 80 of the release means 85.

As shown in FIG. 1, the housing 15 is shaped like a baseball and the portion of the actionable member 35 extending through the housing opening 30 is in the form of a baseball umpire. Typically, the actionable member 35 is characteristic for the sports ball. The actionable member 35 further includes indicia 45 and markings and gestures 46 characteristic of the sport associated with the sports ball.

The alarm clock 10 of the present invention also provides release means 85 for moving the actionable member 35 from a first position in the interior chamber 20 to a second position. The actionable member 35 in the first position is shown in FIG. 5. The actionable member in the second position is shown in FIGS. 1 and 2. In the second position, the actionable member 35 is at least partly extended through the opening 30 of the housing 15.

Figure 6:
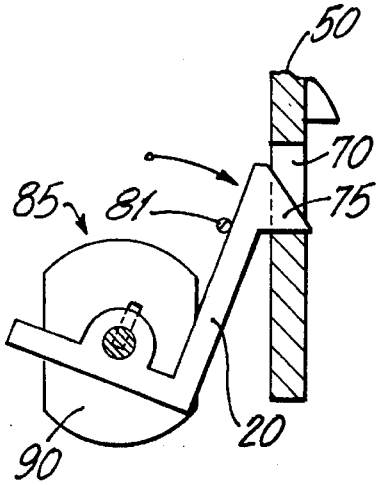
FIG. 6 is a fragmentary enlarged section of the release means shown in FIG. 5 with the projection engaged in the aperture in the actionable member. holder.

Various release means 85 may be provided for the invention. A typical release means 85 is shown in Figures 2–6. The release means 85 operates to move or release the actionable member 35 from the first position substantially within the interior chamber 20 of the housing 15 to a second position. In the second position, the actionable member 35 is at least partly extended through the housing opening 30. In the embodiment shown in FIGS. 2–6, the release means 85 includes an arm 80 with a projection 75 in rotating attachment to a rotary solenoid motor 90. As shown in FIGS. 5 and 6, the actionable member 35 is held in the first position by projection 75 biased in engagement with the aperture 70 by a torque spring 81.

A clock mechanism 95 is mounted within the housing 15. The clock mechanism 95 includes alarm means which are used for setting a preselected alarm signal generated by the clock mechanism 95.

The alarm clock 10 also provides sound generating means 100. In response to the alarm signal, the sound generating means 100 generates a characteristic sound signal. Sound generating means 100 employed in the present invention include a microcomputer 130, a memory, an analog-to-digital converter, an amplifier and a speaker. The sound generating means 100 typically produces a characteristic sound signal which can be a voice recitation characteristic for the shape of the actionable member 35. Microcomputer circuity, including program and alarm signal information and sound generating means, is well known in the art and will not be described in detail.

In accordance with the present invention, actuation means 105 are provided for operating the release means 85 and for operating the sound generating means 100 in response to the alarm signal. The actuation means 105 typically comprise elements, such as electrically conductive wire 105 and well known circuits, which electrically connect the clock mechanism 95 with the release means 85 and the sound generating means 100. The actuation means 105 are in further electrical connection with a switch 110 which can effectively disable the characteristic sound signal when the actionable member 35 is manually displaced from the second position into the first position. The actuation means 105 according to the present invention includes means for connecting the actuation means 105 to an AC power supply. Alternatively, the invention provides a battery power supply connected to the actuation means 105.

The alarm clock 10 includes a time-base means 115 which is operated in conjunction with the microcomputer 130. The time-base means 115 is for timing an interval during which reoccurring sequences of the characteristic sound signal are produced. A manually operable switch 120 connected to the microcomputer is provided for canceling the reoccurring sequences of characteristic sounds generated from the sound generating means 100.

A clock display 125 is typically mounted within the housing 15. The clock display 125 can be digital or it can be analog, as shown in FIG. 1. A manually operable switch 120 mounted on the clock display 125 is provided for activating the alarm signal at predetermined times. This manually operable switch is also capable of providing the alarm signal with various sequences or protocols.

As shown in FIG. 5, a switch 110 is provided within the housing 15 for canceling the reoccurring sequences of sounds or voices comprising the characteristic sound signal generated from the sound generating means 100. The switch 110 disables the characteristic sound signal when the actionable member 35 is manually displaced from the second position to the first position. As shown in FIG. 5, the carrier portion 50 of the actionable member 35 engages the switch 110 when the actionable member is displaced into the first position. The switch 110 is connected to the alarm circuity by means of an electrical connection included in the actuation means 105. This switch 110 cancels and is capable of automatically resetting the alarm sound.

Figure 7:
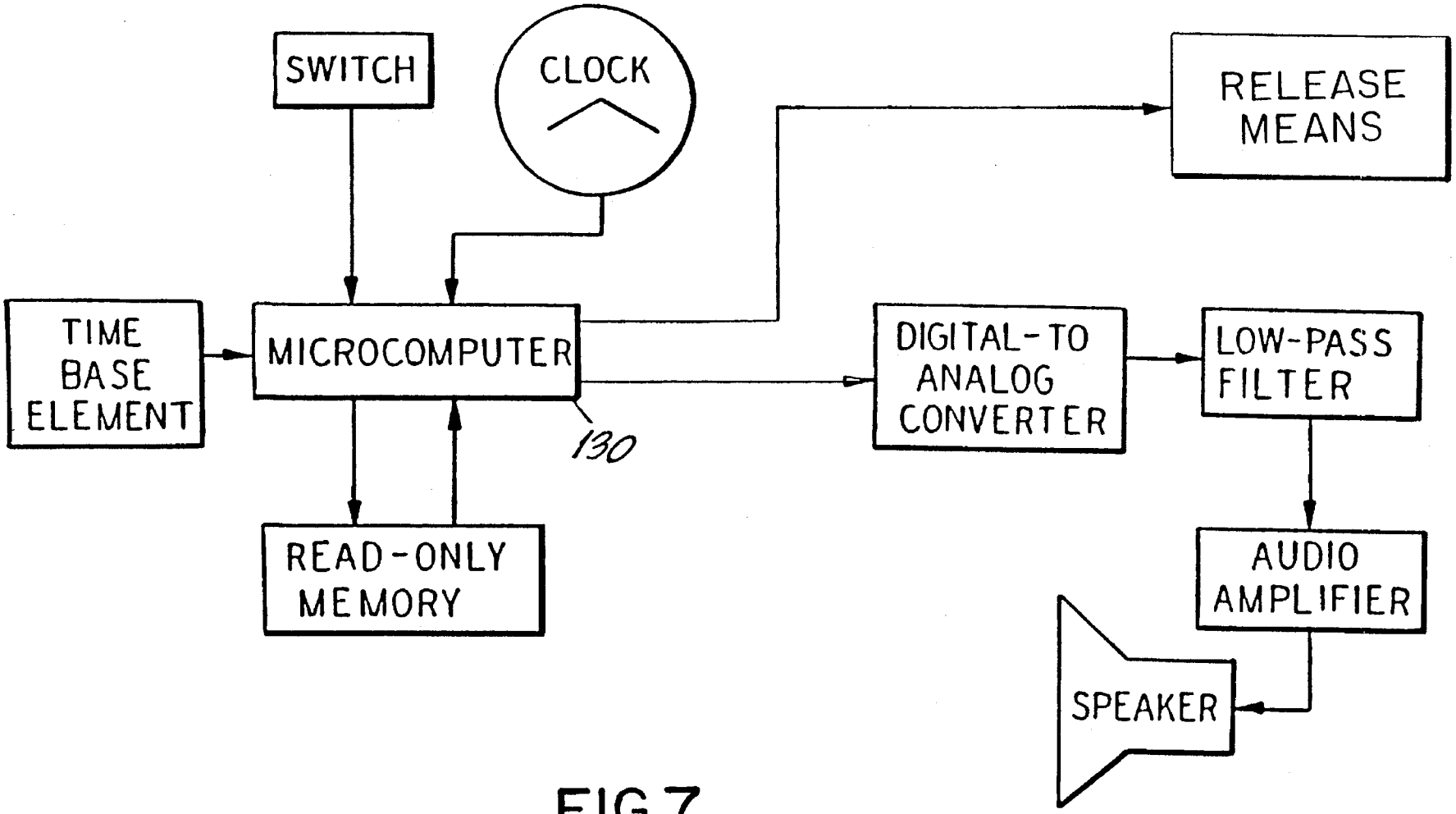
FIG. 7 is a functional block diagram of a circuit for generating sound and for releasing an actionable member for use in the alarm clock of the present invention.

Sound generating means 100 and clock mechanisms 95 employing microcomputerized circuitry are well known in the art. Accordingly, the present invention is not limited precisely to the embodiments of sound generating means 100 and clock mechanisms 95 described herein. Thus, by way of example and not by limitation, the alarm clock 10 of the present invention can be constructed in accordance with FIG. 7, which is a circuit schematic showing the sound generating means 100 and clock mechanism 95 employed in the circuitry of the present invention. The circuit includes a clock mechanism 95 which is preferably a known clock mechanism having an alarm control output that is activated when a preset alarm time has been reached. The clock mechanism 95 can be either digital or analog, or of any other type. A microcomputer 130 is provided for a sound generating and alarm sequence protocol control. An alarm signal sequence is initiated by the microcomputer 130 when an alarm signal is received thereby over the alarm control output. A time-base means 115 such as a quartz crystal supplies a regular time signal to the microcomputer 130 so that the alarm signal protocol, sound generation, and other functions are coordinated. The microcomputer 130 is also linked to a read-only memory which contains an encoded digital representation of the desired characteristic sound signal for the alarm such as the characteristic voices for the human figure represented by the actionable member. The read-only memory may also contain other program data necessary to the operation of the circuit. Although the encoded representation can take any of several well known forms, it is preferably a sequence of binary values, equally spaced in time, which correspond to the wave shape to be reproduced. The wave shape of the illustrated embodiment is, "Don't argue with me, you're outta here," which corresponds to the characteristic shape of the umpire actionable member extending out of the housing shaped like a baseball.

When an alarm signal occurs, the microcomputer 130 transmits an encoded signal over an output to a digital to analog converter which accepts the digital bit sequence for conversion into a corresponding voltage value in the form of the desired characteristic sound signal. At the output of the digital-to-analog converter is a low-pass filter which removes unwanted frequences from the reconstructed characteristic sound signal to prevent distortion of the characteristic sound signal. The low pass filter feeds an audio amplifier which in turn transmits an amplified signal to a speaker from which the desired characteristic sound signal is broadcast. Further, when the alarm signal occurs, the microcomputer 130 transmits an encoded signal over an output to the release means 85 to activate rotation of the rotary solenoid motor 90, causing rotation of the projection 75 located on the arm 80, thereby disengaging the projection 75 from the aperture 70 of the carrier portion 50 of the actionable member 35 and releasing the actionable member, allowing the actionable member 35 urged by the spring 60 to upwardly travel and extend at least partly through the housing opening 30. A step or annular shoulder 135 formed in the wall of the interior chamber 20 limits the upward travel of the actionable member 35.

The switch 110 is also linked to the microcomputer 130 and is activated by a user through manually displacing the actionable member 35 from the second position to the first position to cancel the alarm signal. Operation of the switch 110 also causes a re-alarm sequence protocol to be executed by the microcomputer 130, which uses a regular timing signal from the time-base means 115.

Through the use of known microcomputer programming techniques, any number of different alarm sequence protocols could be provided for the alarm signal. In one example, the alarm sound, "Don't argue with me, you're outta here" —the digital encoding for which is in the read-only memory—is repeatedly sounded for approximately 30 seconds and then automatically shut off. Other alarm sequences may be digitally encoded in read-only memory.

The alarm signal is transmitted at the preset time as determined by setting the clock mechanism 95 from the clock display 125. Preferably, the alarm signal would be periodically rebroadcast for a predetermined period of time after the preset time so that, if the user chooses to disregard the original characteristic sound signals of the alarm generated from the sound generating means 100, the user could "snooze" and still be awakened later by a further alarm signal. In one embodiment, for example, the alarm sequence could be broadcast at the preset time, and again, as needed, 15 minutes later, 30 minutes later, 40 minutes later, or up to an hour after the preset time. The microcomputer times the sequence periods by using the signal from the time-base means 115.

Both the initial alarm signal, and the one hour follow up sequence of alarm sounds could be canceled and reset at any time during this one hour period by manipulation of manually operable switches 120 on the clock display 125. Such switches 120 for resetting sequences of alarm signal are well known in the art.

Although the present invention has been described in considerable detail with regard to certain preferred versions, other versions are possible. For example, the sound generating means may include any number of known speech synthesizer devices for delivering audible messages regarding hours and minutes at a predetermined alarm signal. Also available are devices for sequentially fetching a plurality of words stored in the memory of the speech synthesizer for delivering an audible message and for loading into memory other information regarding the predetermined alarm signal setting.

It should be understood that the present invention can use any number of shapes and themes for the housing 12, actionable member 20, and characteristic sound signal. For example, theatrical or musical themes may be employed wherein the housing, actionable member, and characteristic sound signal portray the well known Disney cartoon characters, or other characters such as Superman, Batman, Spiderman. Alternatively, the housing may be shaped as a lawyer's or doctor's bag, the actionable member respectively shaped as a judge/lawyer or doctor, with appropriate characteristic sound signals provided. Another version involves the housing shaped like a musical instrument, the actionable member shaped like a famous musician associated with that instrument, and the characteristic sound signal being combinations of music and/or words associated with the famous musician.

It should be understood that according to the present invention, other versions of the alarm clock may involve the housing with a plurality of interior chambers, the surface defining a plurality of openings into the plurality of interior chambers, and a plurality of actionable members located within the interior chambers.

Having thus described exemplary embodiments of the present invention, it should be noted by those skilled in the art that the disclosures herein are exemplary only and that various other alternatives, adaptations and modifications may be made within the scope of the present invention. Accordingly, the present invention is not limited to the specific embodiments as illustrated herein, but is only limited by the following claims.

What is claimed is:

1. An alarm clock for emitting a characteristic sound signal and a moving display signal at a predetermined time, comprising a housing having an interior chamber and a surface defining an opening in said housing;

an actionable member including a carrier portion located within said interior chamber and having an aperture, said actionable member being sized to fit through said housing opening;

release means at least partially extended in said aperture for moving said actionable member from a first position in said interior chamber to a second position;

an electronic clock mechanism mounted within said housing, said clock mechanism including alarm means for setting a pre-selected alarm signal generated by said clock mechanism;

electronic sound generating means for generating a characteristic sound signal in response to said alarm signal; and electronic actuation means for operating said release means and for operating said sound generating means in response to said alarm signal wherein said actionable member is manually displaceable to said first position thereby terminating said characteristic sound signal and thereby resetting said alarm signal and said sound generating means.

2. The alarm clock of claim 1 wherein said housing further includes a base.

3. The alarm clock of claim 1 wherein a clock display is mounted within said housing.

4. The alarm clock of claim 1 further including a switch mounted within said housing effective to disable said characteristic sound signal when said actionable member is manually displaced from said second position into said first position.

5. The alarm clock of claim 1 wherein said housing is in the form of a sports ball, said housing bearing indicia and markings to simulate said sports ball and said actionable member having the form of a human being, said human being bearing indicia, markings, and gestures characteristic of the sport associated with said sports ball wherein said characteristic sound signal is a voice recitation, said voice recitation being characteristic for said characteristic actionable member associated with said sport.

6. The alarm clock of claim 1 wherein said housing is in the form of a sports ball, said housing bearing indicia and markings to simulate said sports ball and said actionable member having the form of a human being, said human being bearing indicia, markings, and gestures characteristic of the sport associated with said sports ball wherein said characteristic sound signal is a characteristic voice recitation, said voice recitation being characteristic for said characteristic actionable member associated with said sport, wherein said housing includes a switch mounted within said housing effective to disable said characteristic sound signal when said actionable member is manually displaced from said second position into said first position.

7. The alarm clock of claim 1 wherein said sound generating means is contained within said base.

8. The alarm clock of claim 1 wherein said clock mechanism and clock display are digital, said clock mechanism being contained within said base and being connected to said clock display.

9. The alarm clock of claim 1 wherein said clock mechanism and clock display are analog, said clock mechanism being contained within said base and being connected to said clock display.

10. The alarm clock of claim 1 wherein said sound generating means includes:

a microcomputer adapted for receipt of a signal through said actuation means for operation upon receipt of said signal;

a memory connected to said microcomputer for storing a signal corresponding to said characteristic sound signal;

an analog-to-digital converter connected to said microcomputer to receive said signal corresponding to said characteristic sound signal;

an amplifier connected at an output of said analog-to-digital converter; and a speaker connected at an amplified output of said amplifier for broadcasting said characteristic sound signal.

11. The alarm clock of claim 10 further comprising:

a time-base means operable in conjunction with said microcomputer for timing an interval during which reoccurring sequences of said characteristic sound are produced.

12. The alarm clock of claim 11 further comprising a manually operable switch connected to said microcomputer to cancel said reoccurring sequences of said characteristic sounds.

13. The alarm clock of claim 5 wherein said sports ball is selected from the group of sports balls consisting of baseballs, footballs, basketballs, golf balls, and soccer balls.

14. The alarm clock of claim 6 wherein said sports ball is a baseball and said actionable member is a baseball umpire, said umpire making a thumb gesture wherein said voice recitation is, "Don't argue with me, You're outta here".

15. The alarm clock of claim 1 further including a battery power supply.

16. The alarm clock of claim 1 further comprising means for connecting said clock to AC power.

17. An alarm clock for indicating a predetermined time by an alarm signal, comprising:

a housing in the shape of a sports ball, said housing having an interior chamber and a surface defining an opening in said housing;

an actionable member including a carrier portion located within said interior chamber and having an aperture, said actionable member being sized to fit through said housing opening;

release means at least partially extended in said aperture for moving said actionable member from a first position in said interior chamber to a second position;

an electronic clock mechanism mounted within said housing, said clock mechanism including alarm means for setting a pre-selected alarm signal generated by said clock mechanism;

electronic sound generating means for generating a characteristic sound signal in response to said alarm signal; and electronic actuation means for operating said release means and for operating said sound generating means in response to said alarm signal wherein said housing is in the form of a sports ball, said housing bearing indicia and marking to simulate said sports ball and said actionable member having the form of a human being, said human being bearing indicia, markings, and gestures characteristic of the sport associated with said sports ball wherein said characteristic sound signal is a voice recitation, said voice recitation being characteristic for said characteristic actionable member associated with said sport wherein said actionable member is manually displaceable to said first position,thereby terminating said characteristic sound signal and thereby resetting said alarm signal and said sound generating means.

18. The alarm clock of claim 17 wherein said housing includes a switch mounted within said housing effective to disable said characteristic sound signal when said actionable member is manually displaced from said second position into said first position.

19. The alarm clock of claim 17 wherein a clock display is mounted within said housing.

20. The alarm clock of claim 17 wherein said sound generating means is contained within said base.

21. The alarm clock of claim 17 wherein said clock mechanism and clock display are analog, said clock mechanism being contained within said base and being connected to said clock display.

22. The alarm clock of claim 17 wherein said clock mechanism and clock display are digital, said clock mechanism being contained within said base and being connected to said clock display.

23. The alarm clock of claim 17 further including a battery power supply.

24. The alarm clock of claim 17 further comprising means for connecting said clock to AC power.

* * * * *